US008238803B2

(12) United States Patent
Anderson et al.

(10) Patent No.: US 8,238,803 B2
(45) Date of Patent: Aug. 7, 2012

(54) DOCTOR BLADE SURFACE ENERGY MODIFICATION

(75) Inventors: Richard Kent Anderson, Georgetown, KY (US); Martin Victor DiGirolamo, Lexington, KY (US); Mark Duane Foster, Lexington, KY (US); Whitney April Greer, Lexington, KY (US); Mark William Johnson, Lexington, KY (US); David Starling MacMillan, Winchester, KY (US); Robert Watson McAlpine, Lexington, KY (US); Donald Wayne Stafford, Lexington, KY (US); Jason Carl True, Lexington, KY (US); James Thomas Welch, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 674 days.

(21) Appl. No.: 12/344,568

(22) Filed: Dec. 28, 2008

(65) Prior Publication Data

US 2009/0169273 A1 Jul. 2, 2009

Related U.S. Application Data

(60) Provisional application No. 61/017,459, filed on Dec. 28, 2007.

(51) Int. Cl.
*G03G 15/08* (2006.01)

(52) U.S. Cl. ..... 399/284

(58) Field of Classification Search ..... 399/284
See application file for complete search history.

(56) References Cited

U.S. PATENT DOCUMENTS

| | | | | |
|---|---|---|---|---|
| 5,153,657 | A * | 10/1992 | Yu et al. | 399/350 |
| 6,263,180 | B1 * | 7/2001 | VanLaeken et al. | 399/284 |
| 2005/0260014 | A1 * | 11/2005 | Nakano et al. | 399/284 |

FOREIGN PATENT DOCUMENTS

JP 08314343 A * 11/1996

* cited by examiner

*Primary Examiner* — David Gray
*Assistant Examiner* — Erika J Villaluna
(74) *Attorney, Agent, or Firm* — Justin M Tromp

(57) ABSTRACT

The present disclosure relates to a surface energy reduction material in the form of a topcoat or additive to a coating that may be applied to a toner regulating member such as a doctor blade which may reduce toner build-up about a nip region, pre-nip region, and/or post-nip region. The surface energy reduction material may be include any material having a surface energy of less than or equal to 35 dynes/cm, for example, between 15-30 dynes/cm, including all values and ranges therein. The surface energy reducing materials may include any material that provides a 25% or more reduction of the surface energy of the doctor blade compared to an untreated doctor blade, for example, greater than or equal to 50% reduction or greater than or equal to 75% reduction, including all values and ranges therein.

18 Claims, 3 Drawing Sheets

DOCTOR BLADE SURFACE ENERGY MODIFICATION

CROSS REFERENCES TO RELATED APPLICATIONS

This patent application claims priority under 35 U.S.C. §119(e) to U.S. provisional application Ser. No. 61/017,459, filed Dec. 28, 2007.

BACKGROUND

1. Field

The present disclosure relates generally to an additive and/or coating that may be applied to a toner regulating member such as a doctor blade which may reduce the accumulation of toner in a pre- and/or post-nip area, which accumulation may lead to print quality defects.

2. Description of the Related Art

Image forming devices, such as printers, copiers, fax machines, etc., utilize a number of components to transfer toner from a toner reservoir to a photoconductor and ultimately to a sheet of paper, or other media. For example, a photoconductor may be charged utilizing a charging device and selectively discharged to form a latent image thereon. Toner may then be transferred onto the photoconductor from the reservoir via differential charging of the photoconductor, toner and developer rollers or transfer rollers. From the photoconductor, toner may then be deposited onto a sheet of paper, creating the desired image. The transferred toner may then be fused to the paper by a fuser or other fixation device.

One step in the electrophotographic printing process generally involves providing a relatively uniform layer of toner on a toner carrier, such as a developer roller, that in turn supplies that toner to the photoconductive element. It may be advantageous for the toner layer to have a uniform thickness and a uniform charge level. One approach to regulating the toner on the toner carrier is to employ a so-called doctor or metering blade. However, problems may develop due to adhesion of the toner to the doctor blade which may then interfere with the overall doctoring procedure, for example, resulting in various print quality defects including, but not limited to, skid-marks.

SUMMARY

An aspect of the present disclosure relates to an electrophotographic image forming device comprising a toner carrier and a toner regulating member supported against the toner carrier wherein the toner regulating member may define a pre-nip region, nip region and optionally, a post-nip region. Any one or more of these regions may be configured with a reduced surface energy, sufficient to reduce and/or eliminate the accumulation of toner at such locations. The surface energy of any such locations may be less than or equal to 35 dynes/cm, for example, between 30-15 dynes/cm, including all values and ranges therein. Such locations may also include at least one surface energy reducing material including one or more compounds that utilize inorganic and/or organic compounds containing silicon and fluorine. In addition, the surface energy reducing material may include certain hydrocarbon polymers.

Another aspect of the present disclosure relates to a toner regulating device having an external surface defining a pre-nip region, nip region and optionally, a post nip region. Any one or more of these regions may provide a surface energy of less than or equal to 35 dynes/cm, for example, between 30-15 dynes/cm, including all values and ranges therein.

A further aspect of the present disclosure relates to a method for reducing the surface energy of a toner regulating device comprising providing at least one surface energy reducing material having a surface energy less than or equal to 35 dynes/cm, and applying the surface energy reducing material to at least a portion of at least one of the pre-nip, nip region, an post-nip region of the toner regulating device.

Yet another aspect of the present disclosure relates to a method for reducing skid-marks (an area starved of toner) on a printed media comprising providing a toner regulating device and reducing the surface energy of at least a portion of the toner regulating device at least 25%. This may be achieved by application of at least one surface energy reducing material having a surface energy less than or equal to 35 dynes/cm to a selected portion the toner regulating device. Applying the surface energy reducing material may include coating at least a portion of at least one of the nip region, pre-nip region, and post-nip region of the toner regulating device. It may also include incorporating the surface energy reducing material into an existing coating formulation. Finally, it may also include the incorporation and dispersing of the material into the body of the blade wherein at least a portion of the material may reside on the blade surface.

BRIEF DESCRIPTION OF THE DRAWINGS

The above-mentioned and other features and advantages of this present disclosure, and the manner of attaining them, will become more apparent and the present disclosure will be better understood by reference to the following description of embodiments of the present disclosure taken in conjunction with the accompanying drawings, wherein.

DETAILED DESCRIPTION

Figure 1:
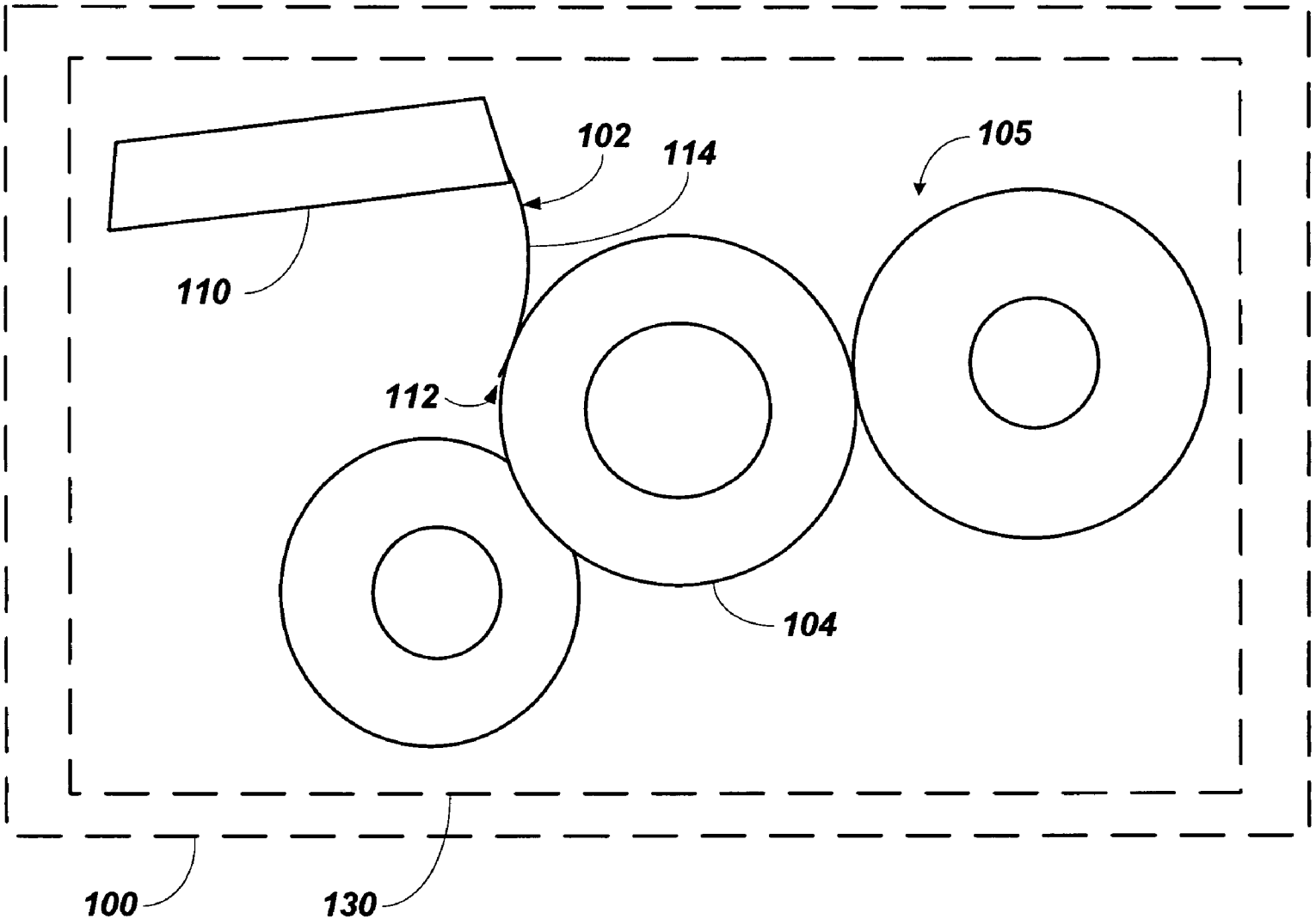
FIG. 1 is a schematic drawing of an example of a toner carrier and a toner regulating device in an electrophotographic image forming device.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

According to one embodiment, the present disclosure may be directed to a toner regulating device within an image forming device as generally illustrated in FIG. 1. FIG. 1 depicts one embodiment of a representative electrophotographic image forming device, indicated generally by the numeral 100. The term "electrophotographic image forming device" and the like is used generally herein as a device that produces images on a media sheet such as, but not limited to, paper or the like. Examples include, but are not limited to, a laser printer, fax machine, copier, and a multi-functional machine. Examples of an image forming device include Model Nos. C750 and C752 available from Lexmark International, Inc. of Lexington, Ky.

As illustrated in FIG. 1, during the transfer of toner in an electrophotographic image forming device 100 a toner regulating device, such as a doctor blade, 102 may interact with a toner carrier, such as a developer roller 104, to regulate the thickness of toner deposited onto the developer roller 104 which in turn supplies toner to the photoconductive roller 105. The toner regulating blade 102 may be positioned relative to the developer roller 104 on a bracket 110. Thus, the regulating blade 102 may include a mounting portion, which may mount on the bracket 110 and a metering portion, which may form a nip 112 with the developer roll 104. The nip 112 may therefore be understood to be that location where the toner regulating device surface 114 and toner carrier are in contact. In addition, at the nip location 112, the toner regulating blade 102 may be configured to contact the toner carrier and press against the carrier with a desired force per unit length. Such force may be about 0.08-1.0 N/mm.

Figure 2:
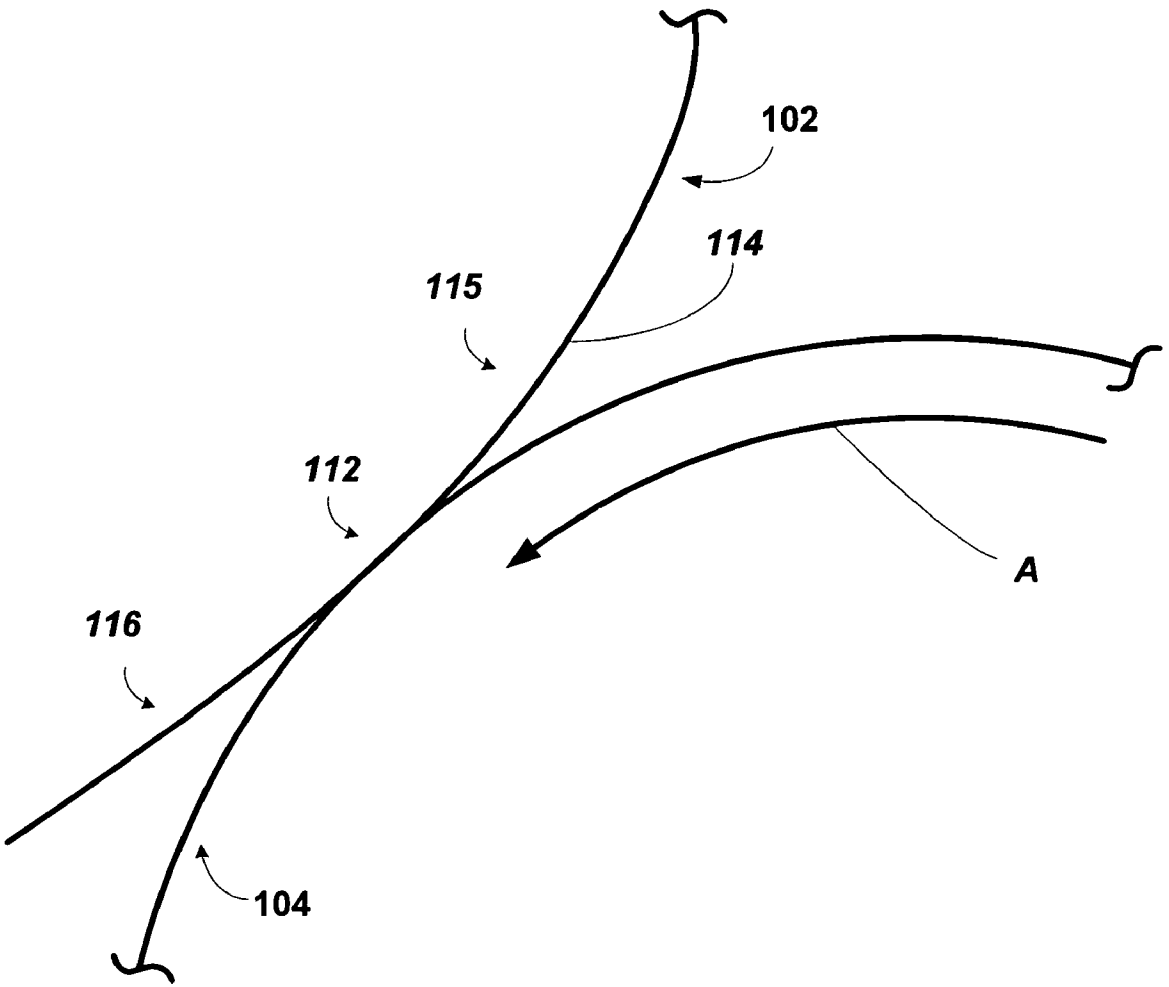
FIG. 2 is a schematic drawing providing an expanded exemplary view of the pre-nip region, nip region and post-nip region between the toner regulating device and toner carrier.

A more exploded cut-away view of the toner regulation device 102 is provided in FIG. 2. As can now be seen, the developer roll 104 may rotate in the direction of arrow A. The nip 112 may be more clearly identified as that general region where the surface 114 of toner regulating device 102 is in contact with the surface of the developer roll 104. Such nip 112 may have a length of about 0.5 to 1.5 mm. In addition, as may now be appreciated, a pre-nip region may be present, illustrated generally at 115, which corresponds to that region proximate the toner regulation device 102 preceding the nip 112 in the direction of rotation of the developer roll 104 which may not be in contact with the roller 104. Such pre-nip region 115 may have a length of about 0.25 mm to 2.5 mm. A post-nip region may be present, illustrated generally at 116, which corresponds to that region proximate the toner regulation device 102 subsequent to the nip 112 in the direction of rotation of the developer roll 104 which may not be in contact with the roller 104. Such post-nip region 116 may have a length of about 0 to 2.5 mm.

With the above in mind, it may now be appreciated that during a given printing operation, toner, which may include a relatively fine powder containing polymeric resin, pigment and other additives, may be transferred from a toner bin (not shown) to the photoconductor through the nip 112 formed between the developer roller 104 and regulating (doctor) blade 102. However, during use, it has been observed that toner may actually adhere to the surface 114 of the toner regulating member 102, for example, at those regions that are not in contact with the developer roller 104, such as in the in the pre-nip and/or post regions 115, 116 noted above. This may be caused by local build-up due to the frictional engagement at the nip 112 between the blade 102 and roller surface 104 which may then cause the toner to bind to the surface 114. The build-up of toner on the doctor blade 102 during use may restrict and/or interrupt the flow of toner through the nip 112 and onto the developer roller 104. This may create an area on the printed media starved of toner. This may be visible as a relatively light area (i.e. having less toner than intended) which may be known as a skid-mark defect. The problems associated with toner build-up about the nip 112 have been observed with numerous constructions of doctor blade 102 including, but not limited to, compliant coated abrasive blades (e.g., pocket flex blades), cantilevered blades, radiused metal blades (e.g., checkmark blades), as well as rigid (e.g., ingot) blades. Additionally, the problems associated with toner build-up may be generally more severe as toner particle size decreases and printing speeds increase, both of which are current trends for future development. For example, such toner build-up may become more of a problem with chemically produced toner (CPT), where the toner particle size of about 1-25 microns may be established without the use of mechanical pulverization.

It is worth noting that in the past, various attempts to promote continuous and/or un-interrupted toner flow through the nip 112 relied upon the use of lubricants such as graphite, molybdenum disulfide, as well as other lubricating powders, slip agents and the like. While the various lubricants may have reduced the formation of skid-marks, it has been observed that the friction between the toner, the doctor blade 102 and the developer roller 104 may cause such lubricants to wear away. As may be appreciated, this may actually exacerbate the problems associated with providing continuous and/or un-interrupted flow through the nip 112 due to, e.g., an uneven friction created across the nip 112. Additionally, it has been observed that the resulting loose residual lubricant (which may break off the doctor blade 102 in the form of powder or particles) may interfere with the application of toner. Moreover, the lubricating powder may interfere with the application of adhesives during the fabrication of the doctor blade 102. While the use of binders may prolong lubrication at the nip 112, the formation of skid-marks may still be problematic.

The present disclosure has recognized that by controlling the surface energy of the doctor blade, one may reduce and/or prevent undesirable accumulation of toner in the pre- and post-nip areas noted herein. More specifically, the present disclosure may reduce and/or eliminate the accumulation of toner about the doctor blade 102 thereby maintaining a relatively more uniform and/or continuous flow of toner through the nip 112 by reducing the surface energy of the doctor blade 102. As a result, the formation of skid-marks in the printed media may be reduced and/or eliminated.

For example, one or more regions of the surface 114 of the doctor blade 102 may include at least one surface energy reducing material having a relatively lower surface energy compared to that of the doctor blade 102 without the surface energy reducing material. The surface energy reducing material may be incorporated into the body of the externally coated surface of the doctor blade 102 and/or applied as a separate topcoat to the doctor blade 102 and/or be incorporated in the body of the blade. The surface energy reducing material may be used with any construction of doctor blade 102 including, but not limited to, compliant coated abrasive blades (e.g., pocket flex blades) such as those described in U.S. Pat. No. 5,797,076 which is incorporated fully herein by reference and assigned to the assignee of the present application, cantilevered blades, radiused metal blades (e.g., checkmark blades), as well as rigid (e.g., ingot) blades.

For example, the surface energy reducing material may include one or more compounds that utilize silicon, fluorine, and/or organic elements such as, but not limited to, fluorine-based resins, silicon-based resins, and/or organic resins. Examples of resins having suitable surface energies to employ as a coating or within the doctor blade itself, include, but are not limited to, perfluorolauric acid film, paraffin-based resin, polyolefin-based resins such as polyethylene and polypropylene, tetrafluoroethylene resin, perfluoroalkoxy resin, fluorinated ethylene propylene resin, tetrafluoroethylene/perfluoroalkyl vinyl ether copolymer resin, tetrafluoroethylene/ethylene copolymer resin, trifluoroethylene chloride resin, vinylidene fluoride resin, perfluorooctylethyl acrylate resin, fluorinated acrylic polymer, and fluorinated methacrylic polymer; silicone-based resin; imine-based resin; urethane-based resin, acrylic-based resin; and films comprising at least one resin selected from the above-mentioned resins. In the case of the aforementioned polymers, they may have number average molecular weights of about 2500-500,000, including all values and increments therein.

The surface energy reducing materials may also include one or more silanes, which may be understood to be any silicon analogue of an alkane hydrocarbon according to the general formula $Si_nH_{2n+2}$. The surface energy reducing materials may include one or more polymerized and/or un-polymerized siloxanes which may be understood to be defined by the general formula $R_2SiO$ wherein R may include hydrogen and/or a hydrocarbon group such as, but not limited to, dimethylsiloxane $[SiO(CH_3)_2]_n$ and/or diphenylsiloxane $[SiO(C_6H_5)_2]_n$. The surface energy reducing materials may further include one or more fully and/or partially substituted fluorosilanes such as, but not limited to, $SiF_4$ (fully substituted fluorosilane) and/or $SiH_nF_{4-n}$ (partially substituted fluorosilane, wherein n is an integer of 1-3). Additionally, the surface energy reducing materials may include one or more fluoroalkanes which may be understood to be an alkane having one or more hydrogen atoms substituted with fluorine. The surface energy reducing materials may include a mixture of one or more of any of the above examples.

Other examples of surface energy reducing materials may include a mixture of siloxanes in an alcohol base such as polyalkyl hydrogen siloxane, ethanol and isopropanol, which may be commercially available from UNELKO Corp. under the trade name "RAIN-X THE INVISIBLE WINDSHIELD WIPER®" as well as an aqueous mixture of siloxanes such as oligomeric siloxane and water, which may be commercially available from RESENE PAINTS LIMITED under the trade name "AQUAPEL." Other examples of fluorine-containing and/or silicon-containing compositions include perfluoro compounds (for example, but not limited to, perfluorocarbons containing six carbon atoms), fluoroalkanes (such as, but not limited to, 1,1,2 trichloro-1,2,2 trifluorethane, which may be commercially available from NyLube Products under the trade name "NYEBAR"), fluoroalkenes (such as, but not limited to, propene, 1,1,2,3,3,3-hexafluoro, oxidized, polymerized), fluoroacrylate polymers (which may be commercially available from 3M Electronic Market Materials Division under the trade name "NOVEC 1700"), fluorosilane polymers (which may be commercially available from 3M Electronic Market Materials Division under the trade name "NOVEC 1720"), fluoroaliphatic polymers (for example, fluoroaliphatic polymers available from 3M Electronic Market Materials Division under the trade names "FLUORAD FC722," "FLUORAD FC724," "FLUORAD FC725" and "FLUORAD FC732" as well as "NOVEC ELECTRONIC COATING EGC-1700") and/or fluorocarbon polymers.

One or more of the surface energy reducing materials discussed herein may be formed into a mixture in the presence of a liquid solvent, which combination may then be applied to and made to adhere to a selected region of the blade surface, along with removal of the carrier liquid. The concentration of the surface energy reducing materials in the solvent may be less than 0.1% wt. to 3.0% wt, including all values and increments therein, for example less than 2% wt to about 0.1% wt, for example, between 0.1% wt to 0.2% wt. The solvent may include water or an organic alcohol, such as isopropanol, ether (e.g., methyl nonafluoroisobutyl ether and/or methyl nonafluorobutyl ether), or any other organic solvent that will readily evaporate and provide the desired release coating characteristics such as, but not limited to, fluorinate and/or chlorinated solvents. The liquid medium may also include a mixture of solvents, wetting agents, dispersants or surfactants that may assist in providing a uniform thickness to the coating on a given toner regulating device surface.

When applied as a topcoat to the doctor blade 102, the topcoat of surface energy reducing materials may have a resulting thickness after removal of the liquid of less than or equal to 1 micron, including all values and increments therein. For example, the topcoat of surface energy reducing materials may have a thickness of 0.01-0.005 micron including all values and increments therein. The topcoat of surface energy reducing materials may be applied using any known techniques including, but not limited to, dip-coating, spraying, brushing, and the like. In addition, the topcoat may be uniform, e.g., the topcoat may be present in the nip region 112, pre-nip region 115, and/or post-nip region 116 at a thickness of less than 1 micron, ±0.25 micron. In such manner, it may now be appreciated that the surface energy reducing materials may be applied to all or a selected region of the regulating doctor blade 102 such that the coating thickness after removal of the liquid is less than or equal to 1.0 micron. The topcoat herein may also be characterized as one which provides a static coefficient of friction of 0.25 or less, including all values and increments in the range of 0.01 to 0.25.

When incorporated directly into the doctor blade 102 resin, the surface energy reducing materials may be present in a range of 0.10 to 10.0% by weight, including all values and increments therein. As may be appreciated, in the case of a doctor blade sourced from a polymeric type material one may incorporate the surface energy reducing material in the polymeric material prior to blade formation. In such manner, the surface energy reducing material may then exist within the blade as well as at the surface, thereby providing a blade surface with a relatively reduced surface energy, as disclosed herein.

Figure 3:
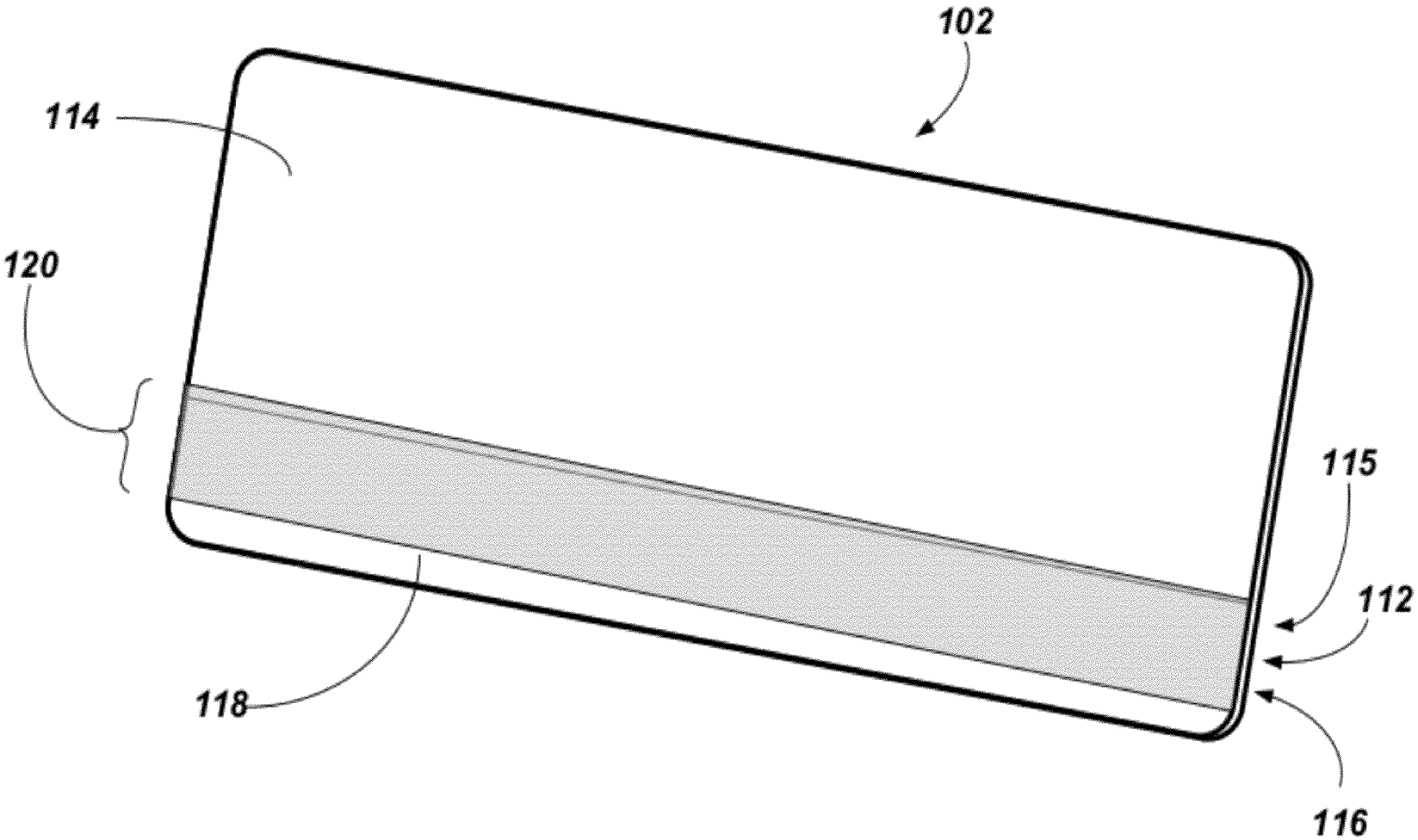
FIG. 3 is a drawing of an exemplary toner regulating device and a selected location where topcoat of surface energy reducing materials may be applied.

Attention is therefore directed to FIG. 3, which illustrates that the regulating doctor blade 102 may have a general rectangular form formed from a substrate material (e.g. metal or polymer material, such a MYLAR®). As mentioned above, the regulating doctor blade 102 may include any construction including, but not limited to, compliant coated abrasive blades (e.g., pocket flex blades), cantilevered blades, radiused metal blades (e.g., checkmark blades), as well as rigid (e.g., ingot) blades. According to one embodiment, the surface energy reducing materials may form a topcoat 118 applied to at least a portion 120 of the surface 114 of the doctor blade 102. For example, the portion 120 of the surface 114 of the doctor blade 102 upon which the topcoat 118 of surface energy reducing materials may be applied may ultimately define at least a portion of area of the nip region 112, the pre-nip region 115, and/or the post-nip region 116 when the doctor blade 102 is engaged with a roller, as noted above.

However, as also alluded to above, and in the context of the present disclosure, the surface energy reducing materials herein may be applied entirely onto one or more surfaces 114 of the doctor blade 102 and such coating may be the only coating on the blade, or a subsequent coating to some underlying coated layer, which underlying coating layer may separately provide some desirable surface roughness. Additionally, as also alluded to above, the surface energy reducing materials may include an additive to the existing coating formulations. As may be appreciated, when the surface energy reducing materials includes include an additive to the existing coating formulations, the surface energy of the entire surface 114 of the doctor blade 102 may be reduced.

It may be appreciated that the regulating blade 102, developer roller 104, and photoconductor 106 may all be located within a given toner cartridge 130. See again, FIG. 1. The toner cartridge 130 may be removable from an image forming device 132 and may itself include a reservoir for storing toner. Accordingly, the individual components, i.e., the regulating blade, developer roller or photoconductor, may all ultimately be located directly within an electrophotographic image forming device 100.

The surface energy reducing materials may include any material that provides a surface energy reduction to the blade sufficient to reduce and/or eliminate accumulation of toner in either the pre-nip or post-nip region. For example, the surface energy reducing material may provide a surface energy of less than or equal to 35 dynes/cm, for example, less than or equal to 20 dynes/cm, and less than or equal to 15 dynes/cm, including all values and ranges therein. For example, the surface energy reducing material may have a surface energy of between 15-30 dynes/cm, between 5-15 dynes/cm and/or 10-13 dynes/cm, including all values and ranges therein. In addition, the surface energy reducing materials may include any material that provides 25% or more reduction of the surface energy of the doctor blade 102 compared to an untreated doctor blade (i.e., a doctor blade that does not include a surface energy reducing material as described herein), for example, greater than or equal to 50% reduction or greater than or equal to 75% reduction, including all values and ranges therein.

It is also noted, that while reference herein is made to a regulating blade and developer roller, various other toner regulating devices and toner carrier devices may be contemplated. For example, toner regulating devices may include a toner agitator, which may agitate the toner within a toner cartridge. The toner regulating device may include other rollers, such as a transfer roller, which may transfer toner from the toner reservoir to the developer roller. In addition to developer rollers, toner carrier devices may include toner reservoirs whose surfaces may also benefit from the toner release coating disclosed herein.

Upon application of the surface energy reducing materials herein to a doctor blade in a Lexmark Zephyr and Jagger electrophotographic printer, it was observed that there was about an 80-100% reduction in skid-marks. In other cases, such results were achieved without any reduction in print quality or negative effect on toner mass or charge control.

The foregoing description of the present disclosure has been presented for purposes of illustration. It is not intended to be exhaustive or to limit the present disclosure to the precise steps and/or forms disclosed, and obviously many modifications and variations are possible in light of the above teaching.

What is claimed is:

1. An electrophotographic image forming device comprising:

a toner carrier;

a toner regulating member supported against the toner carrier wherein the toner regulating member defines at least one of a pre-nip region, a nip region and a post-nip region; and the region comprises a surface energy reducing material forming an outer layer of the toner regulating member having a thickness between about 0.005 microns and about 0.01 microns.

2. The device of claim 1 wherein:

the region has a surface energy less than or equal to 35 dynes/cm.

3. The device of claim 1 wherein:

the region has a surface energy between 30-15 dynes/cm.

4. The device of claim 1 wherein:

the surface energy reducing material comprises a hydrocarbon polymer.

5. The device of claim 1 wherein:

the surface energy reducing material is provided in the form of a coating on the toner regulating member.

6. The device of claim 1 wherein:

the toner regulating member comprises a doctor blade.

7. The device of claim 6 wherein:

the doctor blade comprises at least one of a compliant coated abrasive blade, a cantilevered blade; a radiused metal blade and a rigid blade.

8. The device of claim 1, wherein the surface energy reducing material comprises at least one of a silane compound and a siloxane compound.

9. The device of claim 1, wherein the surface energy reducing material comprises at least one silane.

10. The device of claim 1, wherein the surface energy reducing material comprises at least one siloxane compound in an alcohol base.

11. A toner regulating device for electrophotographic image forming comprising:

a doctor blade having a surface defining at least one of a pre-nip region, a nip region and a post-nip region when the doctor blade is supported against a toner carrier; and the region comprises a surface energy reducing material having a surface energy of less than or equal to 35 dynes/cm and comprises an outer layer of the doctor blade having a thickness between about 0.005 microns and about 0.01 microns on the surface of the doctor blade.

12. The device of claim 11 wherein:

the region has a surface energy is between 30-15 dynes/cm.

13. The device of claim 11 wherein:

the surface energy reducing material comprises a hydrocarbon polymer.

14. The device of claim 11 wherein:

the surface energy reducing material is provided in the form of a coating on the doctor blade.

15. The device of claim 11 wherein:

the doctor blade comprises at least one of a compliant coated abrasive blade, a cantilevered blade; a radiused metal blade and a rigid blade.

16. The toner regulating device of claim 11, wherein the surface energy reducing material comprises at least one of a silane compound and a siloxane compound.

17. The toner regulating device of claim 11, wherein the surface energy reducing material comprises at least one silane.

18. The toner regulating device of claim 11, wherein the surface energy reducing material comprises at least one siloxane compound in an alcohol base.

* * * * *